United States Patent [19]

Kistner

[11] 4,376,512

[45] Mar. 15, 1983

[54] COATING SYSTEM

[76] Inventor: Kenneth Kistner, P.O. Box 132A, Delta, Ohio 43515

[21] Appl. No.: 208,502

[22] Filed: Nov. 20, 1980

[51] Int. Cl.[3] ..... B05B 7/04

[52] U.S. Cl. ..... 239/106; 239/142; 239/304

[58] Field of Search ..... 239/61, 106, 110, 112, 239/113, 142, 303, 304, 307, 310, 369, 398, 407, 413, 414, 428, 569, 583, 586, 525–528; 222/135, 138, 145; 366/272, 301

[56] References Cited

U.S. PATENT DOCUMENTS 3,368,799 2/1968 Sluijters ..... 366/272 X 3,229,911 1/1966 Carlson et al. ..... 239/142

3,409,222 11/1968 Gelin ..... 239/142 X 4,005,825 2/1977 Schowiak ..... 239/413

*Primary Examiner*—Johnny D. Cherry

*Attorney, Agent, or Firm*—Emch, Schaffer & Schaub Co.

[57] ABSTRACT

A system for mixing multi-component high viscosity coating and for spraying the mixed coating onto a surface. The coating components are combined by folding together in a desired ratio and subsequently mixing in a gear mixer.The mixed components are atomized and discharged from a spray gunm onto the surface. A solvent system is provided for purging the mixed coating either from the entire system or only from the spray gun.

8 Claims, 4 Drawing Figures

MOTOR
55
MOTOR
54
65
64
62
PUMP
PUMP
60
61
63
53
66
99

67
68
57
52
56
48
MIXER
15
77
50
51
10
ELECTRIC CLUTCH
100
58
PUMP
MOTOR
59
49
98
19
33
14
97
95
PUMP
COMPRESSED AIR SOURCE
92
96

COATING SYSTEM

BACKGROUND OF THE INVENTION

This invention relates to coating systems and more particularly to an improved system for mixing multi-component, high viscosity coatings and for spraying the mixed coating onto a surface.

In many industries, it is desirable to apply different types of multi-component organic resins with spray applicators. For example, organic foam insulations and fire retardants are often applied to building walls and ceilings in the construction industry. In many instances, resins with desirable properties have not been suitable for spray application due to inability of commercial spray coating equipment to handle such resins. For example, a fire retardant sold under the name "Staytex 4119" potentially has a wide application in the construction industry. A steel or wood building may be insulated by a spray application or a urethane foam. The urethane foam is very effective as an insulation, but is combustible. Application of a thin layer of a fire retardant such as Staytex 4119 over the urethane foam greatly reduces the risk of fire and smoke damage. However, difficulty has occured in spray application of certain fire retardants due to several factors. The organic resin fire retardant is mixed with a catalyst prior to application. After mixing with the catalyst, the resin has a very limited shelf life, which may be on the order of minutes, prior to setting up. The prior art spray applicators have not had a convenient method for purging the mixed resin from the applicator whenever the operator must stop using the applicator for more than a few minutes. The prior art applicators also have not been capable of mixing the resin with the catalyst immediately prior to application. If the resin and catalyst are mixed on a batch basis, the resin may begin to set up before the entire batch has been used. On the other hand, problems have occured with attempting to mix the resin and catalyst on a demand basis with high viscosity resins. For example, spray guns which mix multi-component coatings immediately prior to atomization will not adequately mix high viscosity materials. If the coating is not properly mixed, it may not set up properly or it may not have its intended properties. Problems also arise from the abrasiveness of some fire retardants and other coating materials. The fire retarding properties of a resin sometimes are achieved or enhanced by incorporating an inorganic material such as finely divided sand or portland cement into the resin. Such materials are extremely abrasive and may destroy known types of mixers.

SUMMARY OF THE INVENTION

According to the present invention, an improved coating system is provided for continuously mixing on a demand basis multiple components of a high viscosity coating material such as an organic resin coating and subsequently for spraying such mixed material onto a surface. The individual components of the resin are pumped in a predetermined ratio through a Y or T-shaped pipe where they are folded together and then are supplied under high pressure to a mixer. From the mixer, the mixed resin is delivered to a spray gun where it is atomized and directed by an air stream to a surface to be coated. A low pressure solvent system is connected to flush a resin flow control valve and a barrel of the spray gun, as needed. The solvent also may be supplied from the Y or T-shaped pipe, wherein the resin components are folded together, through the mixer and the spray gun for removing all mixed resin from the system. The mixer preferably comprises a driven or nondriven gear, eccentric worm or helical gear. The high pressure mixed resin is forced through the mixing gear, thereby causing the gears to rotate and completely mix the resin. During the cleaning operation, a motor is connected through a clutch to drive the mixing gear mixer for forcing the low pressure, low viscosity solvent through the mixing gear pump, the connected resin hoses and the applicator gun.

Accordingly, it is an object of the invention to provide an improved system for mixing multi-component high viscosity resin coatings and for spray application of such mixed coatings onto a surface.

Another object of the invention is to provide a system for mixing and the spray application of high viscosity multi-component coatings and in which the system is easily purged of the mixed coating material.

Other objects and advantages of the invention will become apparent from the following detailed description, with reference being made to the accompanying drawings.

DESCRIPTION OF THE PREFERRED EMBODIMENT

Figures 1, 3, 4:
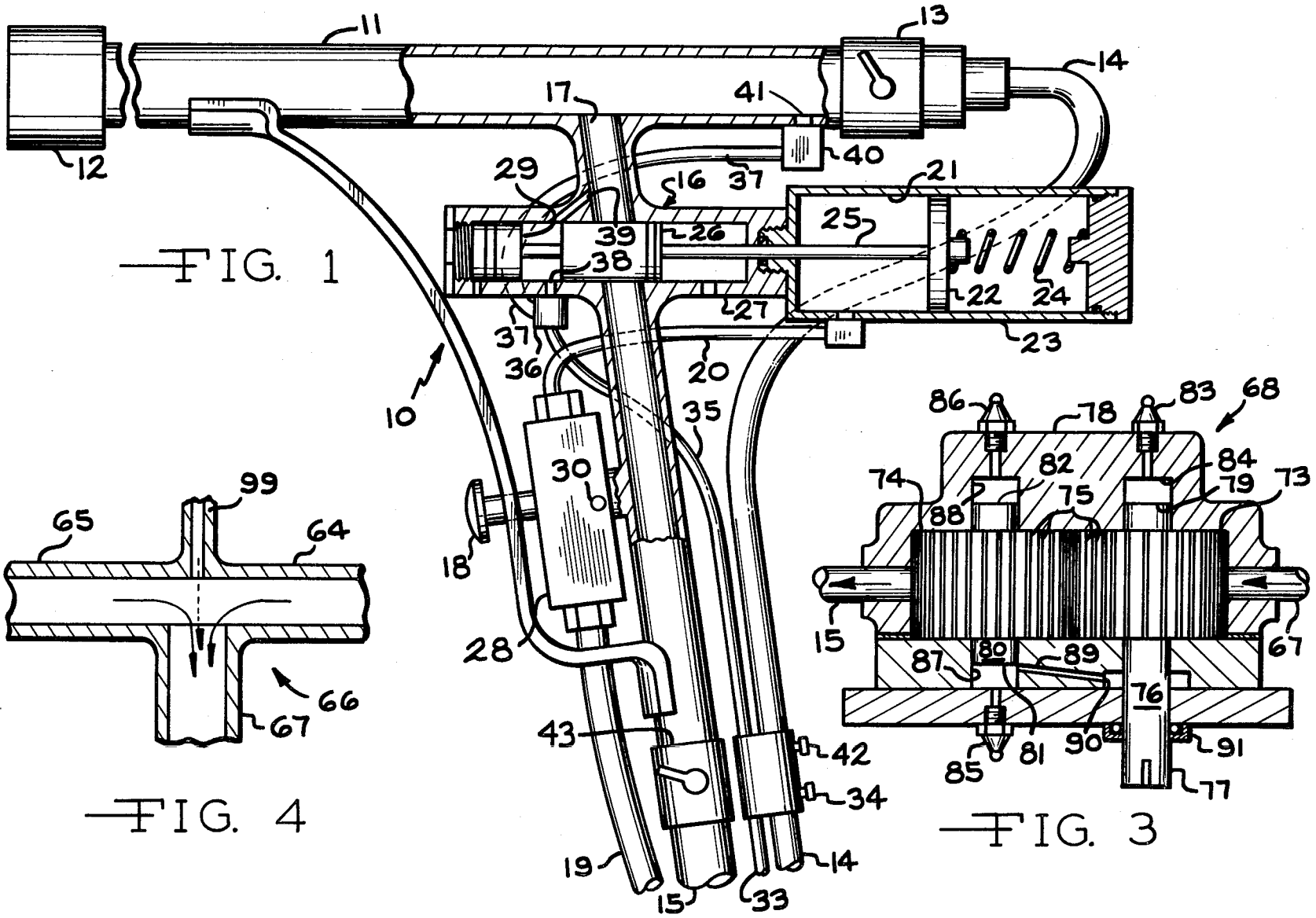
FIG. 1 is a side elevational view, partially broken away, of a coating applicator instructed in accordance with the present invention.
FIG. 3 is a vertical cross sectional view through a gear pump mixer for use in the system of the present invention.
FIG. 4 is a fragmentary cross sectional view of a T-shaped pipe showing the folding action between two resin components which are mixed to form the coating material for use in the system of the present invention.

Turning now to the drawings and particularly to FIG. 1, an applicator or spray gun 10 is shown constructed in accordance with the present invention for spraying highly viscous coatings onto a surface. The applicator 10 is suitable for applying, for example, Staytex 4119 fire retardent sold by Eagle Picher of St. Louis, Mo., onto surfaces such as urethane foam insulation which previously was applied to the walls or ceiling of a building. Of course, the applicator 10 is suitable for use with other high viscosity coating materials.

The applicator 10 has a barrel 11 with an end mounting a nozzle 12 and has an opposite end connected through a manually operable valve 13 to an air supply hose 14. A coating material supply hose 15 is connected through a normally closed valve 16 to a side opening 17 in the barrel 11. When the valve 16 is open and coating material flows from the hose 15 through the valve 16 and the opening 17 into the barrel 11, air from the hose 14 passing through the valve 13 brakes up or atomizes the coating material and carries the coating material through the nozzle 12 to the surface to be coated.

The valve 16 is operated in response to the manual actuation of a trigger 18. Actuation of the trigger 18, applies control air from a compressed air hose 19 to a line 20 which connects to a chamber 21 within a cylinder 23. When compressed air is applied to the chamber 21, a piston 22 is moved by the air pressure in the cylinder 23 against the pressure of a return spring 24. The piston 22 is connected by a rod 25 to a valve member 26 which slides within a cylinder 27. Normally the spring 24 urges the piston 22 to a position wherein the valve member 26 blocks the passage in the material hose 15. When the trigger 18 is actuated, a valve 28 applies control air through the line 20 to the chamber 21 to move the piston 22 and the connected valve member 26 to a position wherein an opening 29 in the valve member 26 aligns with and permits material to flow through the material supply 15 to the barrel 11. When the trigger 18 is released, the application of control air from the hose 19 to the chamber 21 is interrupted and the chamber 21 is vented through the line 20 and a vent opening 30 in the valve 28. At this time, the spring 24 returns the piston 22 and the attached valve member 26 to a normally closed position wherein the passage of material from the hose 15 to the barrel 11 is interrupted. Although the valve 16 has been described as being pneumatically actuated, it will be appreciated that it can be actuated hydraulically or electrically.

A cleaning circuit is provided for flushing solvent through the opening 29 in the material valve 16 and the barrel 11 of the applicator 10. Solvent is applied from a pressurized solvent supply line 33 through a manual push button actuated valve 34 to a line 35. From the line 35, the solvent flows through a fitting 36 both to a line 37 and through an opening 38 into the valve 16. The opening 38 is located to supply solvent to the opening 29 in the valve member 26 when the valve 16 is unactuated or in its normal position and the material hose 15 is blocked. A passage 39 is provided in the cylinder housing 27 to extend between the valve member opening 29 and a hose 15 adjacent the side opening 17 in the barrel 11. The solvent line 37 is connected through a fitting 40 and an opening 41 in the applicator barrel 11 to apply solvent to the barrel 11 at a point located between the side opening 17 and the air valve 13. When the solvent valve 34 is actuated, solvent flows from the supply line 33 through the valve 34 and then through the line 35 and the valve member opening 29 to flush coating material from the valve member opening 29. The flushed material flows through the opening 39 into the barrel 11. At the same time, solvent flows through the line 37 and the opening 41 into the barrel 11. Compressed air from the hose 14 expells the solvent and the residual coating material from the barrel 11 into a suitable waste container (not shown).

A manually actuated push button valve 42 is provided within the air hose 14 adjacent the valve 34. Actuation of the valve 42 applies air from the hose 14 to the line 35. After the valve 34 is operated to flush material from the opening 29 in the material control valve 16 and from applicator barrel 11, the valve 42 is manually actuated to purge solvent from applicator 10. The applicator 10 also is provided with a valve 43 in the material supply hose 15. The closure of the valve 43 blocks flow of coating material to the applicator or spray gun 10 to prevent a discharge of coating material in the event that the trigger 18 is accidentally actuated.

Figure 2:
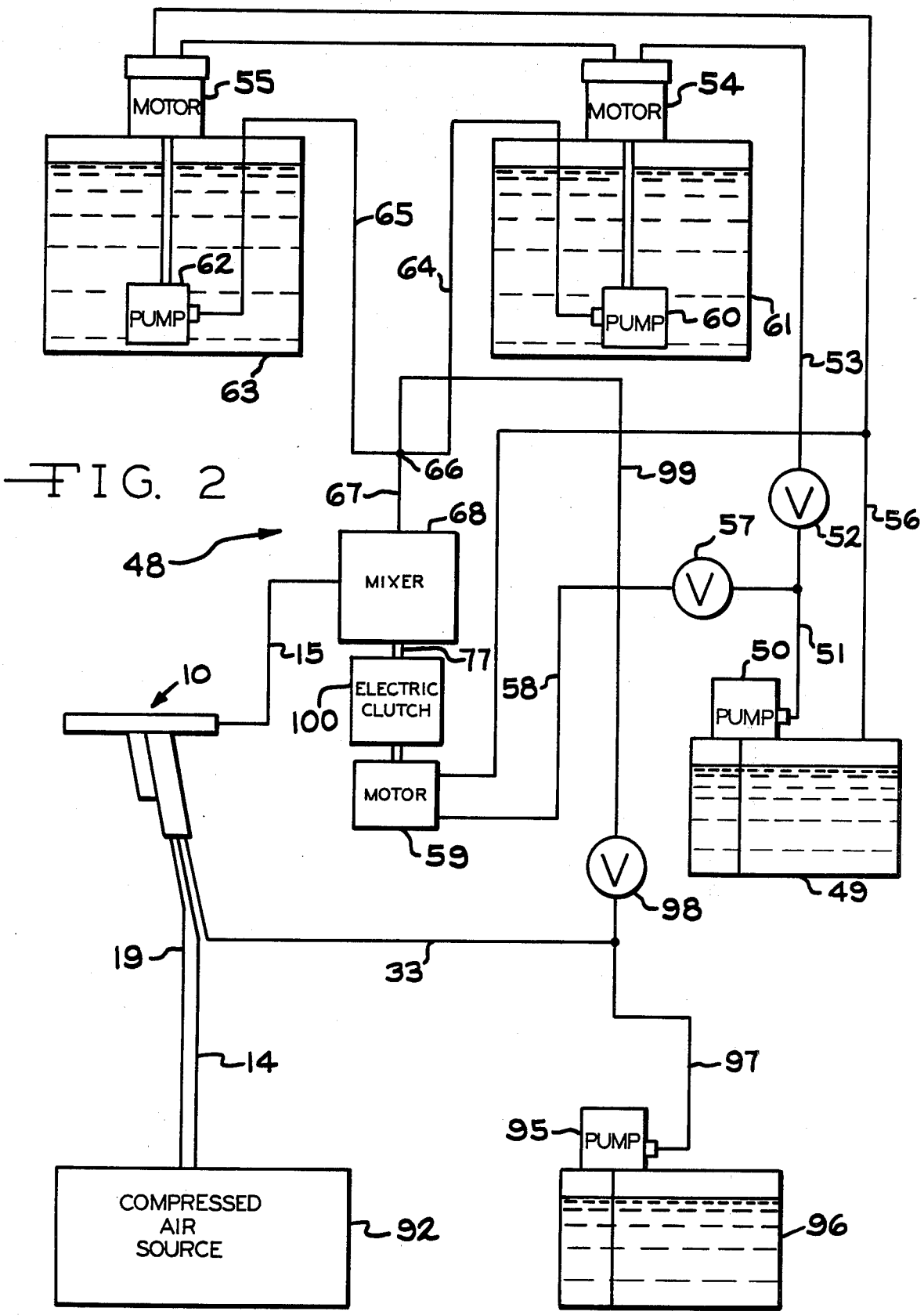
FIG. 2 is a schematic diagram illustrating the coating system of the present invention.

Turning now to FIG. 2, a schematic diagram is shown for a coating system 48 constructed in accordance with the present invention to use the applicator 10. The coating system 48 is hydraulically operated and includes a hydraulic fluid reservoir 49 and a pump 50. The pump 50 supplies a flow of high pressure, hydraulic fluid to a line 51. When a valve 52 is actuated or opened, the hydraulic fluid flows from the line 51 to a line 53 and thence in series through two hydraulic motors 54 and 55 to a return line 56 which carries the hydraulic fluid back to the reservoir 49. When a valve 57 is actuated or opened, the pressurized hydraulic fluid flows from the line 51 to a line 58 and thence through a hydraulic motor 59 to the return line 56 where it is carried back to the reservoir 49.

The hydraulic motor 54 drives a submersible pump 60 which is located within a tank or drum 61 holding one component of the multi-component coating material. Similarly, the motor 55 drives a submersible pump 62 located within a tank or drum 63 holding a second component of the multi-component coating material. By using identical motors 54 and 55 for the driving pumps 60 and 62, respectively, and supplying the hydraulic fluid in series through the motors 54 and 55, the two pumps 60 and 62 are driven at the same speed, regardless of the hydraulic fluid flow rate. If the pumps 60 and 62 are identical, the amount of material supplied by the pump 60 from the drum 61 to a line 64 will be identical to the amount of material supplied by the pump 62 from the drum 63 to a line 65. Or, the pumps 60 and 62 may be selected to provide a desired flow rate ratio relative to one another for a given speed so as to provide a desired mixing ratio between the components of the coating material. It should be noted that the pumps 60 and 62 need not be of the submersible type and that they may be mounted below the material tanks, for example.

The two pipes 64 and 65 are connected together at a Y-shaped or T-shaped connector 66, which is shown in greater detail in FIG. 4. The connector 66 has a single outlet pipe or line 67. The coating material components flow through the lines 64 and 65 at a desired ratio determined by the pumps 60 and 62 and are folded together as they flow into the line 67. Some intermixing of the component is achieved through turbulence. However, such mixing will be of a limited nature due to the high viscosity of the components of the coating material and also the relatively low flow rate. Turning again to FIG. 2, the mixed components in the line 67 flow to a mixer 68 which thoroughly mixes the high viscosity coating and delivers it through the material hose 15 to the spray gun or applicator 10.

Turning now to FIG. 3, details are shown for an exemplary mixer 68. The mixer 68 preferably is a modified, non-driven gear pump through which by the high pressure coating material within the line 67 is forced. However, the mixer 68 may be driven for very high viscosity coatings. The mixer 68 has two gears 73 and 74 which have meshing teeth 75. The gear 73 is mounted on a shaft 76 which has an end 77 extending from a housing 78 and a second end 79 terminating within the housing 78. The gear 74 is mounted on shaft 80 having two ends 81 and 82 which terminate within the housing 78. A grease fitting 83 is provided in the housing 78 for supplying grease to a chamber 84 at the shaft end 79. Similarly, grease fittings 85 and 86 are provided in the housing 78 for supplying grease to chambers 87 and 88 located within the housing 78 adjacent shaft ends 81 and 82, respectively. The chamber 87 communicates through a passage 89 with a chamber 90 which surrounds the shaft 76 between the gear 73 and a seal 91 adjacent the shaft end 77. By filling the chambers 79, 87, 88 and 90 with grease, the high pressure coating material flowing through the mixer 68 will be prevented from flowing around the gears 73 and 74 into clearance areas between the gears 73 and 74 and the housing 78 and between the shafts 76 and 80 and the housing 78. If the grease chambers are eliminated, the mixed coating material will tend to flow into these clearances and may eventually set, causing the mixer 68 to seize and stop functioning. If the grease chambers are eliminated, it will be necessary to periodically dismantle and clean the mixer 68. It should be noted that the mixer 68 may be a worn gear pump in which relatively high clearances exist between the gears 73 and 74 and also between the gears 73 and 74 and the housing 78. Even though relatively high clearances are present, the gear pumps will function efficiently for mixing the components of the coating material. It also should be noted that other types of gear mixers may be used, such as eccentrical worm gears or helical gears.

Referring again to FIG. 2, it should be noted that the pumps 60 and 62 supply the coating material to the mixer 68 at a high pressure, for example, at a pressure in the range of 1,500 psi to 3,000 psi. As the material is forced through the mixer 68 there is a significant pressure drop, so that the material flowing from the mixer 68 to the hose 15 is at a pressure on the order of from 50 psi to 150 psi. This pressure drop across the mixer 68 is sufficient to drive or rotate the gears 73 and 74 and cause the components of the coating material to thoroughly mix. The pressure of the coating material within the hose 15 is high enough to cause the coating material to flow to applicator 10. On the other hand, the pressure is sufficiently low so as not to present a hazard to workman using the applicator 10 in the event that the hose 15 should rupture. The pressure of the coating material within the hose 15 need not be sufficient to spray the coating material onto a workbase or surface to be coated, since the material is atomized and carried by compressed air applied from a compressed air source 92 through the air hose 14 to the applicator 10.

A relatively low pressure pump 95 is provided for supplying solvent from a reservoir 96 to a line 97 and thence to solvent line 33 and also to a valve 98. When an operator actuates the manual valve 34 on the applicator 10, solvent flows from the line 33 to the applicator 10 for cleaning the opening 29 in the valve member 26 and for cleaning the barrel 11, as discussed above. When the entire system is to be purged of mixed coating material, the valve 98 is opened to apply the pressurized solvent through a line 99 to the T-shaped connector 66. As shown in FIG. 4, the line 99 directs solvent through the T-shaped connector 66 towards the line 67 so as to flush all mixed coating material from the connector 66. When the operator then directs the applicator barrel 11 towards a suitable waste container (not shown) and presses the trigger 18, solvent forces the mixed coating materials through the line 67, the mixer 68, the hose 15 and the applicator or spray gun 10. Thus, all mixed material is quickly flushed from the coating system 48 to prevent such material from setting up and clogging the mixer 68, the applicator 10 and the interconnecting hoses and lines. The flow of solvent through the coating system 48 is enhanced by actuating an electric clutch 100 to engage the hydraulic motor 59 with the mixer shaft end 77 and opening the hydraulic fluid valve 57 so that the motor 59 is driven to rotate the gears 73 and 74 within the mixer 68. By driving the mixer 68, the gear teeth 75 and the various chambers and passages within the mixer 68 will be completely purged of the mixed coating material. Also, the driven mixer 68 will supply the solvent at a higher pressure through the hose 15 to the applicator 10 for more efficiently flushing the mixed coating material from the applicator 10.

It will be appreciated that various changes and modifications may be made in the above described coating system 48 without departing from the invention. For example, the coating system has been described for a two component organic resin coating. The motors 54 and 55 and their attached pumps 60 and 62, respectively, may be selected so that the two components are mixed at any desired ratio. In addition, additional reservoirs and pumps may be provided for supplying additional components to the connector 66 upstream from the mixer 68. Or, in a case of a three component system, it may be possible to premix a portion of the components together to reduce it to a two component system in which two separate mixtures are folded together at the connector 66 and subsequently mixed in the mixer 68. In addition, it should be noted that the motors 54 and 55 may be replaced with other motors provided, however, that the motors 54 and 55 must be operated at either the same speeds or at speeds which are at a fixed ratio to one another. For example, the motors 54 and 55 can be replaced with electric synchronous motors which are operated at the same speed. Various other changes and modifications also may be made without departing from the spirit on the scope of the following claims.

What I claim is:

1. A system for mixing and spraying a multi-component high viscosity coating comprising a separate reservoir for at least two different components of the coating, a separate hydraulically operated pump for the material in each reservoir, means for supplying hydraulic fluid in series to said hydraulically operated pumps whereby said pumps are simultaneously rotated, said pumps pumping such different components from said reservoir at a predetermined fixed flow rate ratio to each other, means for folding together such pumped different components, said folding means having a separate inlet for each pumped component and a single common outlet, means for mixing said folded components, said mixing means being connected to said common outlet, applicator means for spraying such mixed components onto a surface, and purging means for cleaning such mixed components from said folding and mixing means and from said applicator means.

2. The coating system of claim 1, wherein said means for folding together such pumped components includes a generally T-shaped connector having a separate inlet for each pumped component and a single common outlet through which such pumped components flow.

3. The coating system of claim 2, wherein said means for mixing such pumped components further includes gear mixing means having an inlet connected to a said common outlet, an outlet connected to said applicator means and two meshed gears, said gears rotating and mixing such coating components as such coating components flow through said mixing means.

4. The coating system of claim 3, wherein said purging means includes means for flowing a solvent through said T-shaped connector, said gear mixing means and said applicator means, and motor means for driving such gears in said gear mixing means.

5. The coating system of claim 4 wherein said motor means drives said gears in said mixing means only when said purging means flows said solvent through said coating system.

6. In a coating system, apparatus for mixing a multi-component settable coating comprising a housing defining and inlet and an outlet, two meshed gears mounted on shafts to rotate in said housing, means for flowing the coating under pressure through said housing, such flowing coating rotating such gears whereby such coating is mixed, and means for preventing such coating from flowing between such shafts and said housing.

7. Apparatus for mixing a multi-component settable coating, as set forth in claim 6, wherein each of said shafts has a portion extending into said housing to either side of an attached gear, and wherein said means for preventing such coating from flowing along such shafts includes a separate chamber surrounding each shaft portion, means closing each of such chambers except for clearances between said housing and said shaft extending between said chambers and said gears, and means for filling each chamber with a substantially non-compressable lubricant whereby such lubricant prevents the coating material from flowing between such shafts and said housing.

8. A system for mixing and spraying a multi-component high viscosity settable coating comprising:

a separate reservoir for at least two different components of the coating;

a separate hydraulically operated pump for the components in each reservoir;

means for supplying hydraulic fluid in series to said hydraulically operated pumps whereby said pumps are simultaneously rotated, said pumps pumping said different components from said reservoirs at a predetermined flow rate ratio to each other;

means for folding together said pumped components, said folding means having a generally T-shaped connector having a separate inlet for each pumped component and a single common outlet through which said pumped components flow;

means for mixing said folded components, said mixing means having a housing defining an inlet and an outlet, said inlet being connected to said common outlet of said folding means, at least two shafts being positioned in said housing, at least two meshed gears mounted on said shafts to rotate in said housing, said gears being adopted to rotate as said components are pumped through said mixing means, each of said shafts having a portion extending into said housing to either side of said gears;

means for preventing said components from flowing along said shafts having a separate chamber surrounding each portion of said shafts that extend into said housing, means closing each of such chambers except for clearances between said housing and said shaft extending between said chambers and said gears, and means for filling each chamber with a substantially non-compressible lubricant whereby said lubricant prevents the components from flowing between said shaft and said housing;

an applicator means connected to said outlet of said mixing means for spraying the mixed components onto a surface;

and purging means for cleaning said mixed components from said folding and mixing means and said applicator means including, pump means for pumping a solvent to said folding means, said mixing means and said applicator means, and drive means connected to said gears in said mixing means for aiding the flow of said solvent through said mixing means and said applicator means, said drive means rotating said gears when said purging means is being used to clean said system.

* * * * *